US009994067B2

(12) United States Patent
Goodman

(10) Patent No.: US 9,994,067 B2
(45) Date of Patent: Jun. 12, 2018

(54) SAFETY ENVELOPE OPENER WITH ANTI-SKIP FEATURE

(71) Applicant: David H. Goodman, Winnipeg (CA)

(72) Inventor: David H. Goodman, Winnipeg (CA)

( * ) Notice: Subject to any disclaimer, the term of this patent is extended or adjusted under 35 U.S.C. 154(b) by 428 days.

(21) Appl. No.: 14/064,450

(22) Filed: Oct. 28, 2013

(65) Prior Publication Data

US 2014/0173915 A1 Jun. 26, 2014

(30) Foreign Application Priority Data

Nov. 22, 2012 (CA) ..... 2797077

(51) Int. Cl.
*B43M 7/00* (2006.01)

(52) U.S. Cl.
CPC ..... *B43M 7/002* (2013.01); *B43M 7/007* (2013.01)

(58) Field of Classification Search
CPC ..... B43M 7/002; B43M 7/007; B27B 7/30
USPC ..... 30/280, 289, 294, 290, 2
See application file for complete search history.

(56) References Cited

U.S. PATENT DOCUMENTS 2,247,840 A 7/1941 Harrison
2,282,062 A 5/1942 Jewett
2,567,739 A * 9/1951 Simon ..... 30/281
2,915,821 A * 12/1959 Partin ..... 30/249
3,432,926 A * 3/1969 Kristal ..... 30/294
3,824,688 A * 7/1974 Goffe ..... B43M 7/002 30/294
3,967,377 A * 7/1976 Wells ..... 30/320
4,581,823 A 4/1986 Gilman
4,873,767 A 10/1989 Lok
5,127,161 A * 7/1992 Ikeda ..... 30/294
5,524,348 A * 6/1996 Tipp ..... B67B 7/30 30/2
5,720,062 A 2/1998 Vaught
6,581,291 B1 * 6/2003 Tarpill et al. ..... 30/90.4
8,607,463 B1 * 12/2013 Stokes et al. ..... 30/478
2002/0133956 A1 * 9/2002 Collins ..... 30/487
2007/0028452 A1 * 2/2007 LaFauci ..... B26B 27/005 30/142
2008/0052924 A1 * 3/2008 Blum ..... 30/485

FOREIGN PATENT DOCUMENTS

EP 190849 8/1986

* cited by examiner

*Primary Examiner* — Andrea Wellington
*Assistant Examiner* — Fernando Ayala
(74) *Attorney, Agent, or Firm* — Kyle R Satterthwaite; Ryan W Dupuis; Ade & Company Inc.

(57) ABSTRACT

An envelope opener features a through slot defining a channel that is closed on three sides around an axis of the slot. A blade projects into the channel from a first closed side thereof to an opposing second closed side thereof, and lies in plane spaced from the closed third side of the channel that lies opposite the mouth. The third side of the channel is angled relative to blade, and the cutting edge slopes away from the first closed side of the channel toward the second closed side, whereby the cutting edge is closer to both the second and third sides of the channel at one end thereof than the other. At the other end, a radiused corner is provided between the third side of the channel and an exterior of the tool. A metal insert lines one or more sides of the channel for an improved wear life.

28 Claims, 3 Drawing Sheets

10
14
12a
30
34
40
30d
30b
24
16
32b
30c
18
32
26
16a
32c

A
W1
30b
30c
36
40
30a
30
X

T1
30
A1
22
24
C 40
30
C
A
B
32
VIEW C
D
26
T1
D

26b
D
W2
26
26a
A2

32

32b
32a
32c
32d
38

B
T
38
32b
32a
38a

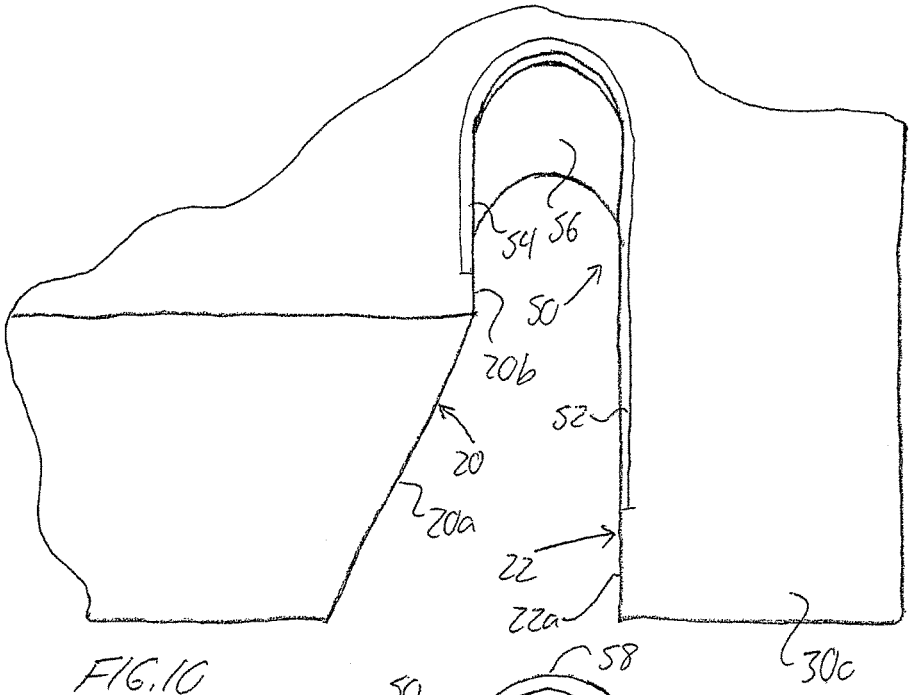
FIG.10
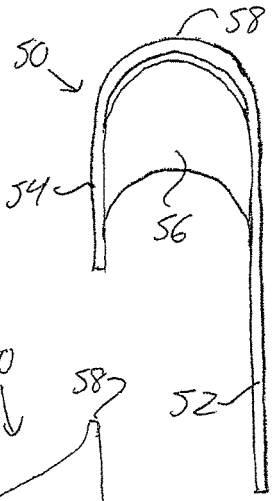
FIG.11
FIG.13
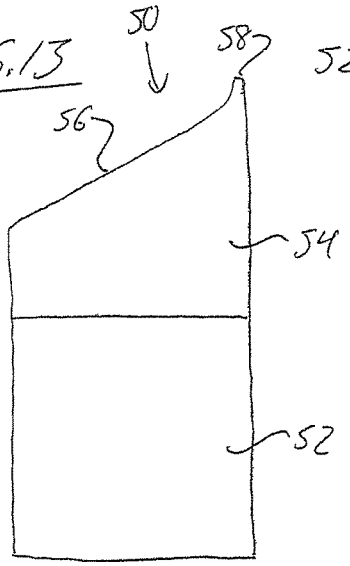
FIG.12
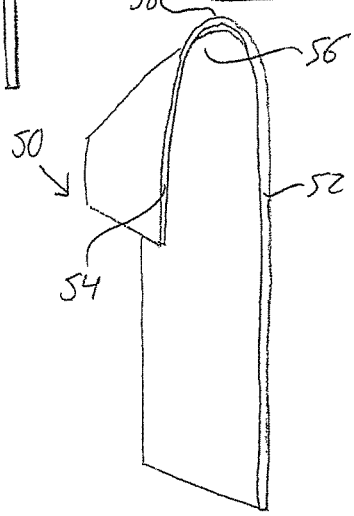

SAFETY ENVELOPE OPENER WITH ANTI-SKIP FEATURE

CROSS REFERENCE TO RELATED APPLICATIONS

This application claims benefit under 35 U.S.C. 119(a) of Canadian Patent Application No. 2,797,077, filed Nov. 22, 2012.

FIELD OF THE INVENTION

The present invention relates generally to envelope openers, and more particularly to envelope openers with a blade safely concealed in a small slot or channel to cut an envelope along an edge thereof under feeding of the envelope through the slot or sliding of the opener over the envelope edge.

BACKGROUND OF THE INVENTION

Safety envelope or letter openers have previously been proposed where a small blade is mounted on a body in a position projecting into a slot that passes through the body. The slot defines a channel that is closed on three of four sides around the slot axis, leaving an open fourth side to define a mouth of the slot for accommodating passage of an edge-adjacent portion the envelope through the slot from the one end to the other along the edge of the envelope the user wants to cut open. The blade projects from one closed side of the channel toward the opposing closed side at a distance outward from the third closed side that connects the first two, thereby placing a point formed at an end of the cutting edge in close proximity to the second side of the channel. An end of the edge-adjacent portion of the envelope is fed into an end of the slot with the edge of the envelope abutted up against the third wall for sliding therealong as either the tool is pulled along this edge of the envelope, or the enveloped is pulled through the slot. By moving the blade along this edge, or moving the envelope through the slot, the cutting edge cuts along the respective edge of the envelope during this relative sliding between the envelope and the tool channel.

Examples of such envelope openers are disclosed in U.S. Pat. No. 2,282,062 of Jewett, U.S. Pat. No. 2,247,840 of Harrison, and U.S. Pat. No. 4,873,767 of Lok.

In making and testing envelope openers of this general type, Applicant found that there is often a tendency for the tool to skip or ride off the edge of envelope during the process of running the tool over the envelope. Accordingly, there remains room for improvement, and applicant has developed a new envelope opener that addresses this complication, and provides additional advantages in terms of ease of use of the opener and convenient carrying of the unit on a keychain for readily available access.

U.S. Pat. No. 4,581,823 discloses another envelope opener for sliding along a peripheral edge of an envelope via a blade-containing channel of the opener, but differs from the forgoing examples in that the tool body is flexible and two legs of the tool body are pinched together in order to move the blade into a position reaching near enough to the opposing leg to cut into the envelope. Attaining a sufficient depth of cut without bunching-up of the envelope paper may be difficult, as the clearance between the cutting edge of the blade and the opposing leg of the flexible tool body is manually controlled by the pinching pressure applied between the thumb and forefinger of the user.

Another prior art letter opener is disclosed in U.S. Pat. No. 5,720,062, but differs notably from the designs referenced above and detailed herein below.

SUMMARY OF THE INVENTION

According to a first aspect of the invention there is provided an envelope opening tool comprising:

a tool body having a slot extending through said body along an axis to pass through opposing first and second exterior faces of said body to define a channel having a first end at said first face and a second end at said second face, said channel being closed on three sides thereof around the axis by opposing first and second closed sides of the channel and a third closed side of said channel interconnecting the first and second closed sides thereof, leaving a fourth side of the channel open between the first and second closed sides of the channel at a position opposing the third closed side; and a blade mounted to the tool body in a position projecting into the channel from the first side thereof toward the opposing second to define a cutting edge positioned within the channel, the blade lying in a plane spaced away from the third closed side of the channel in a direction toward the fourth open side of the channel, and the cutting edge sloping obliquely away from the first closed side of the channel toward the opposing second closed side of the channel in a direction moving from the first end of the channel to the second end thereof;

wherein the closed third side of the channel and the plane of the blade are obliquely oriented relative to one another such that the third closed side of channel is further from the plane of the blade at the first end of the channel than at the second end of the channel.

Preferably the tool body comprises a radiused corner defined between the first exterior face of the tool body and the third closed side of the channel.

Preferably a width of the slot, measured between the first and second closed sides of the channel, is larger at the fourth open side of the channel that at the closed third side of the channel to provide a widened access mouth to the slot at the open fourth side of the channel.

Preferably the first and second closed sides of the channel diverge in a direction moving from the plane of the blade toward the fourth open side of the channel.

Preferably the first and second closed sides of the channel are parallel to one another at a region between the closed third side of the channel and the plane of the blade.

Preferably a gap between the second closed side of the channel and the cutting edge of the blade, at an end of said cutting edge closest to said second closed side of the channel, is between 0.75 and 1.75 thousands, of an inch, and more preferably between 0.75 and 1.5 thousandths of an inch, and for example between 0.75 and 1.25 thousandths of an inch in one embodiment.

In one embodiment, the gap is 1.0 thousandths of an inch at the end of the cutting edge closest to the second closed side of the channel.

Preferably spacing between the plane of the blade and the third closed side of the channel, at the second end of the channel, is between 30 and 75 thousandths of an inch.

Preferably the spacing between the plane of the blade and the third closed side of the channel, at the second end of the channel, is 50 thousandths of an inch.

Preferably an angle between the plane of the blade and the third side of the channel is between 5 and 25 degrees, for example between 5 and 15 degrees in one embodiment.

Preferably the angle between the plane of the blade and the third side of channel is at least 10 degrees.

Preferably the closed third side of the channel is concavely curved to smoothly join with the first and second sides of the channel.

Preferably the tool body has an elongated shape of greater length than width, the first and second closed sides of the channel being spaced apart along the length of the tool body and the third and fourth sides of the channel being spaced apart along the width of the tool body.

Preferably a thickness of the tool body separates the first and second faces thereof and is less than the width of the tool body.

Preferably the tool body comprises a through hole therein for connection of the tool body to a keychain.

Preferably the through hole passes through the body in a same direction as the slot.

Preferably the slot and through hole are positioned adjacent opposite ends of the tool body.

Preferably the plane of the blade is parallel to the axis of the slot.

According to a second aspect of the invention there is provided an envelope opening tool comprising:

a tool body of fixed shape;

a slot having a fixed shape and extending through said body along an axis to pass through opposing first and second exterior faces of said body to define a fixed-shape channel having a first end at said first exterior face and a second end at said second exterior face, said channel being closed on three sides thereof around the axis by opposing first and second closed sides of the channel and a third closed side of said channel interconnecting the first and second closed sides thereof, leaving a fourth side of the channel open between the first and second closed sides of the channel at a position opposing the third closed side; and a blade mounted to the tool body in a fixed position projecting into the channel from the first side thereof toward the opposing second side to define a cutting edge positioned within the channel, the blade lying in a plane that is spaced away from the third closed side of the channel in a direction toward the fourth open side of the channel, the cutting edge sloping obliquely away from the first closed side of the channel toward the opposing second closed side of the channel in a direction moving from the first end of the channel to the second end thereof;

wherein the first closed side of the channel, in a direction moving away from the plane of the blade toward the open fourth side of the channel, slopes at an oblique angle away from a second plane that is occupied by the second closed side of the channel at a region that is located between the closed third side of the channel and the plane of the blade, and the oblique angle of the first closed side of the channel provides a widened mouth of the slot at the open fourth side of the channel;

wherein the axis is perpendicular to said first and second exterior faces, the plane of the blade is parallel to the axis and perpendicular to the second plane, and the closed third side of the channel is obliquely oriented relative to the axis such that the third closed side of the channel is further from the plane of the blade at the first end of the channel than at the second end of the channel;

wherein the tool body is elongated in shape and has a length dimension along which the first and second closed sides of the channel are spaced, a thickness dimension measured between the first and second exterior faces of the tool body, and a width dimension that is greater than the thickness dimension and less than the length dimension; and wherein the tool body comprises a radiused corner curving from the third closed side of the channel to an exterior of the tool body outside the channel at the first end thereof.

According to a third aspect of the invention there is provided an envelope opening tool comprising:

a tool body;

a slot passing through the body on an axis to define a channel that passes axially through opposing exterior faces of the body and opens outward from the tool body on one side of the axis; and a blade mounted to the tool body and projecting into the channel to situate a cutting edge of the blade in a position operable to cut an envelope along an edge of said envelope under relative movement of said edge of the envelope axially through the slot;

wherein the tool body comprises a wear insert defining at least a portion of one or more closed sides of the channel, the insert comprising a material of greater hardness than an adjacent portion of the body at which the insert is seated.

Preferably the wear insert includes an area on a second closed side of the channel toward which the blade extends from an opposing first closed side of the channel, the area overlying a cutting edge of the blade that slopes obliquely away from the first closed side of the channel toward the second closed side of the channel.

Preferably the wear insert spans at least partially from the second closed side of the channel toward the opposing first side of the channel at a closed third side of the channel that joins together said first and second closed sides of the channel and that lies opposite the side of the axis at which the channel opens outward from the tool body.

Preferably the wear insert fully spans the third closed side of the channel from the first closed side thereof to the second closed side thereof.

Preferably the wear insert spans at least partially along the first closed side of the channel from the closed third side of the channel toward the blade.

Preferably the wear insert defines a radiused corner curving from the third closed side of the channel to an exterior of the tool body outside the channel at an end thereof.

Preferably the wear insert comprises metal and the adjacent portion of the body comprises a non-metal material.

Preferably the adjacent portion of the body is plastic.

According to a fourth aspect of the invention there is provided an envelope opening tool comprising:

a tool body having a slot extending through said body along an axis to pass through opposing first and second exterior faces of said body to define a channel having a first end at said first face and a second end at said second face, said channel being closed on three sides thereof around the axis by opposing first and second closed sides of the channel and a third closed side of said channel interconnecting the first and second closed sides thereof, leaving a fourth side of the channel open between the first and second closed sides of the channel at a position opposing the third closed side; and a blade mounted to the tool body in a position projecting into the channel from the first side thereof toward the opposing second to define a cutting edge positioned within the channel, the blade lying in a plane spaced away from the third closed side of the channel in a direction toward the fourth open side of the channel, the cutting edge sloping obliquely away from the first closed side of the channel toward the opposing second closed side of the channel in a direction moving from the first end of the channel to the second end thereof, and the closed third side of the channel and the plane of the blade being obliquely oriented relative to one another such that the third closed side of channel is further from the plane of the blade at the first end of the channel than at the second end of the channel; and wherein the tool body comprises a radiused corner curving from the third closed side of the channel to an exterior of the tool body outside the channel at the first end thereof.

According to a fifth aspect of the invention there is provided an envelope opening tool comprising:

a tool body;

a slot extending through said body along an axis to pass through opposing first and second exterior faces of said body to define a channel having a first end at said first exterior face and a second end at said second exterior face, said channel being closed on three sides thereof around the axis by opposing first and second closed sides of the channel and a third closed side of said channel interconnecting the first and second closed sides thereof, leaving a fourth side of the channel open between the first and second closed sides of the channel at a position opposing the third closed side; and a blade mounted to the tool body in a fixed position projecting into the channel from the first side thereof toward the opposing second side to define a cutting edge positioned within the channel, the blade lying in a plane that is spaced away from the third closed side of the channel in a direction toward the fourth open side of the channel, the cutting edge sloping obliquely away from the first closed side of the channel toward the opposing second closed side of the channel in a direction moving from the first end of the channel to the second end thereof;

wherein the axis is perpendicular to said first and second exterior faces, the plane of the blade is parallel to the axis, and the closed third side of the channel is obliquely oriented relative to the axis such that the third closed side of the channel is further from the plane of the blade at the first end of the channel than at the second end of the channel.

BRIEF DESCRIPTION OF THE DRAWINGS

In the accompanying drawings, which illustrate exemplary embodiments of the present invention:

FIG. 10 is a partial, close up side view similar to FIG. 9, but showing a second embodiment of the envelope opener that features the addition of a metal insert in the channel of the body to allow use of more economic material for the body without sacrificing the durability of the overall opener.

FIG. 11 is a side view of the metal insert of FIG. 10 in isolation.

FIG. 12 is a perspective view of the metal insert of FIG. 11.

FIG. 13 is another view of the metal inserts of FIGS. 11 and 12.

DETAILED DESCRIPTION

Figures 1, 2, 3, 4, 5, 6, 7, 8:
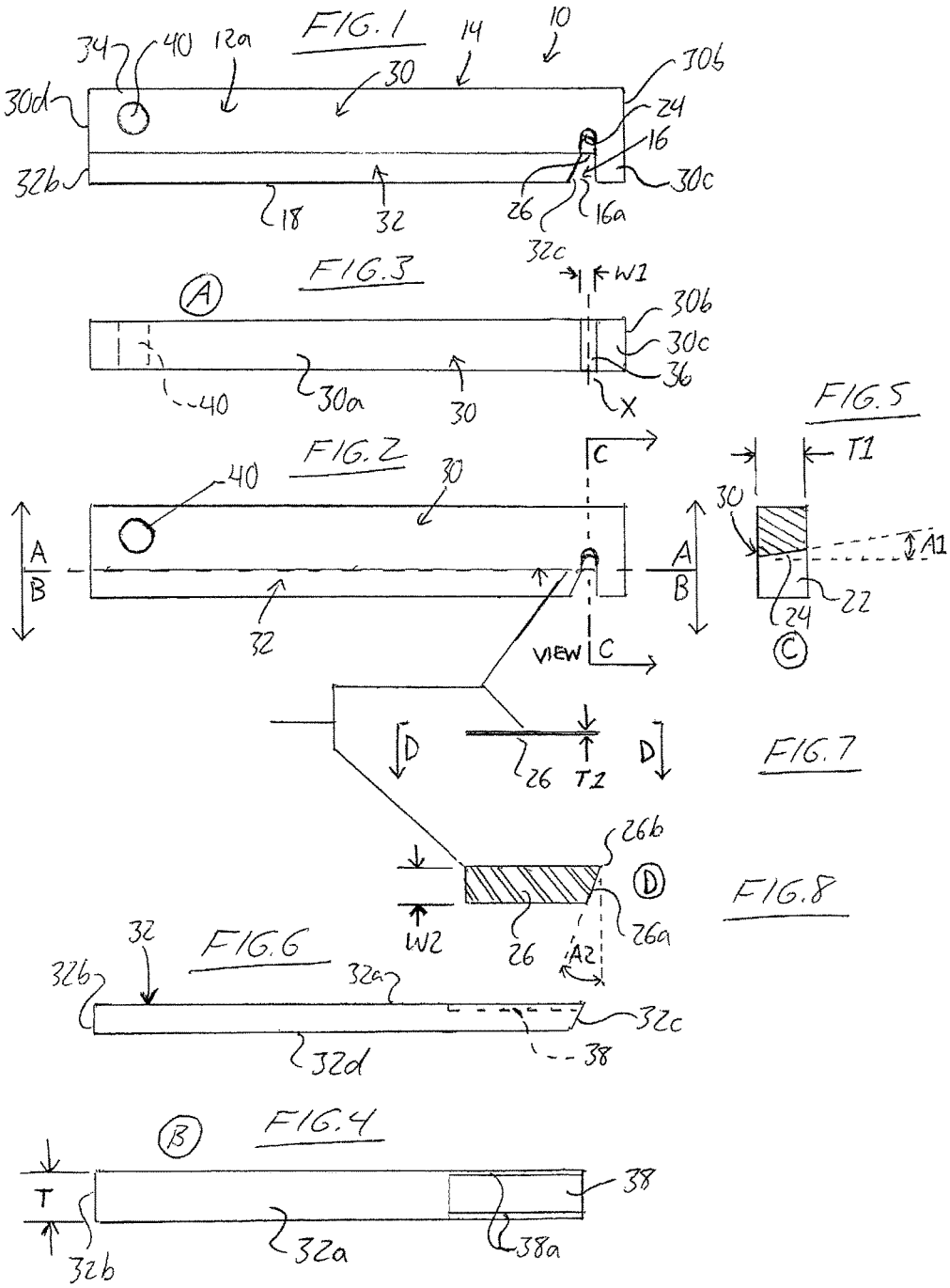
FIG. 1 is a side view of a key chain envelope opener according to a first embodiment of the present invention.
FIG. 2 is the same side view of the first embodiment key chain envelope opener as FIG. 1, but marked up to show viewing planes for subsequent figures.
FIG. 3 is an edge view of a first piece of a two-piece body of the first embodiment envelope opener, as viewed along line A-A of FIG. 2.
FIG. 4 is an edge view of a second piece of the two piece body of the first embodiment envelope opener, as viewed along line B-B of FIG. 2.
FIG. 5 is a cross-sectional view of the two piece body of FIG. 2 as viewed along line C-C thereof.
FIG. 6 is a side view of the second piece shown in FIG. 4.
FIG. 7 is an edge view of a blade of the first embodiment envelope opener.
FIG. 8 is a plan view of the blade of FIG. 7 as viewed along line D-D of FIG. 7.

FIG. 1 shows a key chain envelope opener 10 of the present invention, as viewed from a first flat-faced side 12*a* thereof defining length and width dimensions of an overall tool body 14 of the opener. The length of the body L exceeds its width W, which in turn exceeds a thickness T of the body measured between the first flat face 12*a* of the illustrated side and a matching flat face 12*b* on the opposing side of the body. This thin, elongated body can be comfortably gripped in the hand of a user, for example between the thumb index finger thereof.

Figure 9:
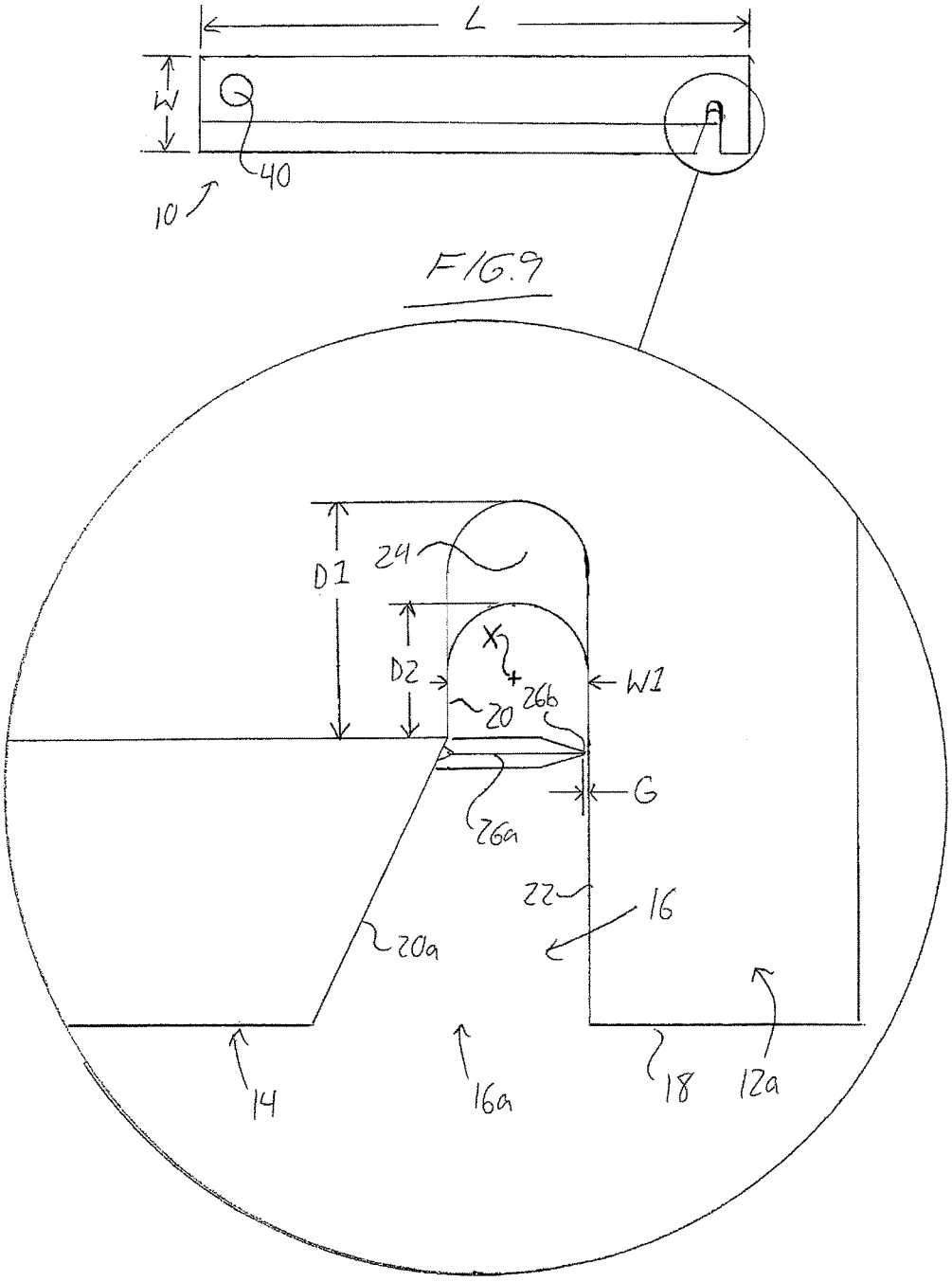
FIG. 9 is a partial, close up side view of the first embodiment envelope opener from the same side thereof as FIG. 1 to better illustrate positioning of the blade inside a slot-defined channel of the two-piece body.

A slot 16 passes through the opposing side faces 12*a*, 12*b* of the tool body along an axis X that is perpendicular to these parallel planar side faces, and juts into the body 14 from an open mouth 16*a* of the slot at a front edge 18 of the body near, but spaced inward from, a respective end of the tool body length L. The slot 16 thus defines a channel that runs through the body in the thickness direction thereof, and is closed on three of four sides around the axis X of the slot. With reference to FIG. 9, first and second closed sides 20, 22 of the slot 16 lie in opposing positions facing toward one another and spaced apart along the length dimension L of the tool body. A third closed side 24 of the channel joins together the first and second closed sides 20, 22 to define the extent to which the slot 16 juts into the tool body from the front edge 18 thereof.

Still referring to FIG. 9, a cutting blade 26 projects into the channel from the first side 20 thereof, and lies in a plane that is parallel to the axis X of the slot and the length L of the tool body. A cutting edge 26*a* of the blade is angled to slope obliquely away from the first closed side 20 of the channel toward the second closed side 22 in a direction moving from a first end of the channel at the first side face 12*a* of the tool body to a second end of the channel at the second side face 12*b* of the tool body. The pointed end 26*b* of the cutting edge 26*a* nearest the second end of the channel stops slightly short of the second side 22 of the channel, leaving a small gap G between the tip of the blade 26 and the second closed side 22 of the channel.

With reference to FIGS. 5 and 9, the third side 24 of the channel does not run along an axis perpendicular to the side faces 12*a*, 12*b*, but rather along an axis that is obliquely sloped relative to these side faces to lie at an angle relative to the blade so that the third side of the channel is at a distance D1 from the plane of the blade 26 at the first end of the channel that is greater than the distance D2 of the third channel side 24 from the plane of the blade 26 at the second end of the channel. A depth of the slot measured from the mouth 16*a* at the open fourth side of the channel at the front edge 18 of the tool body to the opposing closed third side 24 of the channel thus decreases moving through the slot from the first end thereof to the second end thereof. In the illustrated embodiments, the third side of the channel joins the first two sides of the channel through a semicircular arc, thus having a concave shape facing toward the mouth 16*a* of the slot, but other shapes of the closed third side of the channel are encompassed within the scope of the present invention.

A width W1 of the slot channel, measured from the first side 20 thereof to the second side 22 thereof is uniform over an inner portion of the slot's depth spanning from the third side 24 of the channel to the plane of the blade 26 due to a parallel configuration of the opposing first and second sides of the channel at this inner portion. While the second side 22 of the channel lies in a single plane, the first side 20 deviates from a purely planar configuration by angling obliquely from the plane parallel to the second wall at the blade location in order to transition into another plane angling away from the second side over the outer portion of the slot depth that spans from the plane of the blade 26 to the front edge 18 of the tool body. As a result of this angled outer portion 20*a* of the first side 20 of the channel, the width of the slot is greater at the mouth than at the opposing closed third side of the channel.

The angled relationship between the blade 26 and the closed third side 24 of the channel means that when an envelope is inserted into the slot to slide the envelope edge through the closed slot along the closed third side thereof from the first end of the slot to the second end of the slot, or to slide the slot along the envelope edge with the first end of the slot leading the second end, the angled third side of the channel acts as a guide to keep the envelope in an orientation in which the envelope edge is in a non-parallel relationship to the blade. More particularly, the angular relationship between the edge of the envelope and the blade is such that the cutting edge of the blade points obliquely away from this envelope edge at a small angle A1. This way, the cutting action of the blade is directed at a small inward angle relative to the envelope edge at which relative sliding of the envelope and opener is occurring, thereby minimizing or eliminating a tendency for the blade to cut outward through this envelope edge and cause the opener to skip off the envelope and fail to complete the intended cut-line across the envelope a short distance inward from this edge.

Through fabrication and testing of multiple prototypes, applicant has determined a number of preferred dimensions for the envelope opener for optimal performance, although it may be possible to produce effective embodiments outside of the following exemplary dimensions. The gap G between the peak end 26*b* of the cutting edge 26*a* is preferably between 0.75 and 1.75 thousands of an inch, and more preferably between 0.75 and 1.5 thousandths of an inch (thou or mils). In one embodiment, the gap measures between 0.75 and 1.25 thousandths of an inch. A smaller gap or clearance would increase the likelihood of paper jamming in the gap. The gap accommodates the uncut side of the envelope paper, which cooperates with the crease of the envelope to provide strength that resists to the cutting force of the blade so that the envelope paper won't simply bunch up within the gap when acted on by the blade. Referring to FIG. 5, the angle A1 between the blade 26 and the closed third side or inner wall 24 of the channel is preferably between 5 and 25 degrees, and more preferably between 5 and 15 degrees. In one embodiment, the angle A1 is between 10 and 15 degrees. For example, one effective prototype features a dimension D1 of 0.085 inches between the plane of the blade and the inner channel wall at the first end of the slot, and a dimension D2 of 0.050 inches between the plane of the blade and inner channel wall at the second end of the slot, which with a tool body thickness T of 3/16 of an inch (0.187 inches), gives a blade-to-wall angle A1 of approximately 12.5 degrees.

With reference to FIG. 8, the width W2 of the blade 26, as measured along the axis X of the slot 16, may be approximately 0.140 inches. Accordingly, the blade spans less than the full length of the slot, stopping short of each end thereof. The angle A2 of the incline of the cutting edge relative to the second side 22 of the channel 16 may be in the order of approximately 20 degrees. With reference to FIG. 7, the thickness of the blade T1 may be in the order of 0.010 inches. Width W1 of the slot 16 at the uniform inner portion thereof may be 0.050 inches, doubling to 0.100 inches that the widened mouth 16*a* of the slot.

A corner formed between the first side face 12*a* of the body and the third side or inner wall 24 of the channel is rounded or radiused, as best shown at R in FIGS. 5 and 9. The resulting smoothly curved transition between these surfaces avoids a sharp edge that will tend to cause drag or resistance to the relative sliding between the envelope and the opener in drawing the blade along the envelope edge or vice versa.

The drawings are based on a prototype of the invention in which the body is produced by assembly of two originally separate body pieces 30, 32. A larger main piece 30 defines a lengthwise rear edge 34 of the body lying parallel to and opposite the front edge 18 into which the slot of the finished tool extends. The substantial majority of the front edge 18 of the finished tool body however is defined by a smaller cap-like piece 32 that is attached to the main piece 30 during assembly of the opener. A shallow slot 36 juts into a front edge 30*a* of the main piece 30 at a short distance inward from the end 30*b* of the main piece near which the deeper overall slot 16 is to be formed in the final opener. An end portion 30*c* of the main piece 30 located between the shallow slot 36 and the respective end 30*b* of the piece 30 juts forwardly outward from the rest of the main piece to define the second closed side 22 of the channel of the final tool.

The cap piece 32 has a rear edge 32*a* arranged for placement against the front edge 30*a* of the main piece to fully cover the same from the shallow slot 36 to the end 30*d* of the main piece opposite the slot-adjacent end 30*b*. At this end 30*d* of the main piece 30, the corresponding end 32*b* of the cap piece is square and flush with the main piece 30. The opposite end 32*c* of the cap piece however is not square, instead being angled to slope obliquely from the rear edge 32*a* of the cap piece to the front edge 32*d* thereof. When the cap piece 32 is attached to the main piece, the sloped end 32*c* of the cap piece forms the sloped outer portion 20*a* of the first closed side 20 of the slot channel.

As shown in FIGS. 4 and 6, a rectangular recess 38 is formed in the rear edge 32*a* of the cap piece 32, and extends along the rear edge over a partial length thereof from the sloped end 32*c* of the cap piece. The recess spans slightly less than the full thickness of the piece, leaving strip-like portions 38*a* of the unrecessed remainder of the rear edge intact on opposite sides of the recess. The recess has a width and depth sufficient to receive the width and thickness of the blade 26 between these strips 38*a*. A rectangular majority of the blade 36 is accommodated in the recess, leaving a triangular end portion of the blade that projects from the recess. With the blade seated in the recess in this manner, for example along with glue or other adhesive to hold the blade in place, the rear edge 32*a* of the cap piece is abutted up against the front edge of the main piece and attached thereto, for example by glue or other adhesive. The blade 26 is thus sandwiched between the two body pieces so that the triangular end portion of the blade 26 projects into the channel of the slot 16 at the interface of the two pieces, thereby completing the structure of the above described tool. It will be appreciated that the pieces may be fastened together by non-adhesive fastening means.

It will be appreciated that other structures for supporting the blade in a suitable position jutting into the channel may be employed instead of the particular two-piece body assembly described above. Prototypes have been produced using wood, steel and brass bodies, but use of other materials for the body may be employed, for example using plastic construction. These materials are notably hard or rigid, thus providing the body and the channel therein with a fixed, rigid shape that does not flex or deform under normal use. Accordingly, the position of the blade relative to the body is predetermined and fixed so that measurements of the cutting edge from the closed sides of the channel are static and predefined. Examples of suitable blade materials include ceramic, and high carbon steel, although other materials may be employed.

The illustrated embodiments feature a keychain hole 40 passing through the main piece 30 of the body near the end 30*d* thereof opposite the slot 16. The hole passes through the body in the same direction as the slot 16, i.e. through the opposing side faces 12*a*, 12*b* of the body to span the thickness dimension of the body in a direction perpendicular to the side faces. The hole is suitably sized to accommodate passage of a key ring or chain through the body for support of the envelope opener on a key chain. It will be appreciated that the size and general shape of the tool body may be varied from that described and illustrated, and other embodiments may lack a keychain support hole or equivalent feature, while still being operable to open an envelope in the same manner.

FIG. 10 illustrates another embodiment of the present invention, which differs from that described above primarily in the inclusion of a metal insert or liner 50 of greater hardness and durability than a remainder of the tool body. This way, a plastic or other cost-efficient material may be used for a substantial majority of the tool body without detriment to the durability and wear life of the tool, as the metal insert defines the surfaces of the channel that are subject to repeated frictional contact with envelope paper throughout the life of the tool.

The metal insert 50 of the illustrated embodiment is J-shaped in cross-section in planes normal to the axis X. This J-shaped cross-section has two parallel legs 52, 54 that lie opposite one another across an arcuate central web 56 that joins the parallel legs 52, 54 together. During manufacture of the tool, the metal insert 50 is installed on the larger main piece 30 of the tool body prior to assembling the blade 26 and smaller cap piece 32 of the body onto the larger main piece 30. In the installed position of the insert, the central arcuate web 56 of the insert fully and conformingly spans the acutely curved third inner side of the channel, and the parallel legs 52, 54 extend from the arcuate web 56 in order to line portions of the first and second closed sides of the channel, respectively.

The metal insert spans the full thickness T of the tool body in the axial direction of the channel, thus reaching from the first end of the channel at the first side face 12*a* of the tool to the second end of the channel at the opposing parallel side face 12*b* of the tool. At the first end of the channel, the insert features a curved lip 58 that deviates from the otherwise linear span of the arcuate web 56 along the axis X. Here, the lip 58 conforms around the radiused corner R in order to provide a metal lining to this corner, just like the metal lining provided at the three closed sides of the channel by the legs and web of the insert. Alternatively, the main body piece 30 may lack a radiused corner R, with a similar or equivalent radiused corner instead being defined solely by insert, particularly the curved lip of the insert that provides a rounded or radiused transition from inside the channel at the closed third side thereof to the exterior of the main piece of the tool body at the first external face thereof.

In the illustrated embodiment, the short leg 54 of the insert 50 terminates short of the front edge 30*a* of the main body piece 30, leaving an unlined area 20*b* of the inner portion of the first side 20 of the channel. Likewise, the longer leg 52 of the insert 50 terminates short of the front edge of the end portion 30*c* of the main body piece 30, leaving an unlined area 22*a* of the second side 22 of the channel at the widened mouth of the channel. As shown in FIG. 10, channel bordering portions of the main body piece 30 at areas other than these unlined areas 20*b*, 22*a* may be recessed relative to these unlined areas by a depth equal to a thickness of the insert 50, whereby these recessed areas form a seat for receiving the insert 50 in an installed position in which the surfaces of the parallel legs 52, 54 of the insert 50 lie flush with the unlined areas 20*b*, 22*a* of the first and second sides of the channel.

The insert 50 may be configured with a default shape in which the two legs 52, 54 naturally tend to take on a diverging relationship in which they angle apart moving away from the central web 56, in which case it is only by the installation of the insert into the main piece of the body that it takes on the parallel-leg condition of its installed position. In such an embodiment, forcing the insert 50 into the channel in a web-first direction against the resistance provided by the outward biasing of the two legs away from one another overcomes this resilient bias and thus forces the two legs into the recessed areas of the main body on the first and second sides of the channel. In this installed position, the resilient force biasing the two legs of the insert apart from one another retains the insert in the seated position. In addition, or alternatively, the insert may be adhesively secured in place at the interface between the insert and the body on one or more of the closed sides of the channel. In another possible configuration, the insert need not necessarily be recessed into the main body piece so as to lie flush with unlined areas of the same. In embodiments employing a resilient insert design, the insert may be formed of spring steel, thus providing the described resiliency while still providing improved strength and durability over a softer main body material, such as plastic. However, hard metals, or even non-metal materials of greater hardness than the main body material may alternatively be used.

Although the insert of the illustrated embodiment is formed of a bent metal strip of relatively thin sheet-like configuration, thicker metal inserts may alternatively be employed, for example by making appropriate dimensional accommodation for same in the main body piece in order to maintain suitable relative spacing and positioning of elements among the channel and blade structures as described elsewhere herein. Although the illustrated insert uses a J-shaped cross-section in order to line a substantial majority of the second channel side 22 along with a substantial majority of the non-angled inner portion of the first channel side 20 and the entire curvature of the third channel side 24, other shapes may be employed. For example, a U-shaped insert not reaching as far outwardly along the second side 22 of the channel may be employed while still providing a metal lining of the channel's boundary areas that are most prone to wear, particularly the area of the second side of the channel that overlies the cutting edge of the blade, and the closed third side of the channel along which relative sliding occurs between the envelope edge and the opener during use. Other embodiments may feature a shallower J-shape spanning less or none of the first side 20 of the channel, as the envelope paper is run through the channel between the blade and the second side 22 of the channel during use of the opener, and so the first side may not be overly prone to wear. The use of the metal insert to strengthen the channel boundaries acts to better maintain the manufactured dimensions of the channel to maximize the optimal performance life of the tool.

Although a metal insert or liner defining at least part of one or more sides of the channel may prove most valuable when adjacent portions of the tool body surrounding the channel are made of light-weight, low-cost plastic, use of an insert of harder wear material than adjacent portions of the tool body may still provide some advantage or benefit regardless of the particular material makeup of those adjacent body portions. For example, in one possible configuration, a majority of the tool body may employ a lightweight metal, while the insert is made of a harder but heavier and more expensive material, whether metal or otherwise.

The illustrated embodiments are based on a right-handed version of the opener operated by pulling the opener along the edge of the envelope from left to right using one's right hand. An alternate left-handed embodiment would have the reverse direction of slope for the cutting edge and closed inner side of the channel compared against those shown for the illustrated embodiments.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An envelope opening tool comprising:

a tool body of fixed shape;

a slot having a fixed shape and extending through said tool body along an axis to pass through opposing first and second exterior faces of said tool body to define a fixed-shape channel having a first end at said first exterior face and a second end at said second exterior face, said channel being closed on three sides thereof around the axis by opposing first and second closed sides of the channel and a third closed side of said channel interconnecting the first and second closed sides thereof, leaving a fourth side of the channel open between the first and second closed sides of the channel at a position opposing the third closed side; and a blade residing in a first reference plane and having a width measured in and parallel to said first reference plane in a direction in which the first and second ends of the channel are spaced apart, and a thickness that is smaller than said width and is measured perpendicularly to said width and transversely through said first reference plane in a direction in which said third closed side and said fourth side of the channel are spaced apart, said blade being mounted to the tool body in a fixed position projecting into the channel from the first closed side thereof toward the opposing second closed side to define a cutting edge residing in the first reference plane entirely within the channel, the first reference plane and the blade therein both being spaced away from both the third closed side of the channel and the fourth open side of the channel so as to both lie intermediately between the third closed side of the channel and the fourth side of the channel, the cutting edge fully spanning the width of the blade on an obliquely sloped path from a first end of the cutting edge to a second end of the cutting edge that is situated fully across said width of the blade from the first end of said cutting edge, the first end of the cutting edge residing closer to the first end of the channel than the second end of the cutting edge, the second end of the cutting edge residing closer to the second end of the channel than the first end of the cutting edge, and the second end of the cutting edge being located nearer to the second closed side of the channel than the first end of the cutting edge;

wherein the second closed side of the channel, at a region thereof that is located between the third closed side of the channel and the first reference plane, resides in a second reference plane, and the first closed side of the channel, in a direction moving away from the first reference plane toward the open fourth side of the channel, slopes at an oblique angle away from the second reference plane, and the oblique angle of the first closed side of the channel provides a widened mouth of the slot at the open fourth side of the channel;

wherein the axis is perpendicular to said first and second exterior faces, the first reference plane is parallel to the axis and perpendicular to the second reference plane, and the third closed side of the channel has an oblique orientation relative to the axis such that the third closed side of the channel is further from the first reference plane at the first end of the channel than at the second end of the channel;

wherein the tool body is elongated in shape and has a length dimension along which the first and second closed sides of the channel are spaced, a thickness dimension measured between the first and second exterior faces of the tool body, and a width dimension that is greater than the thickness dimension and less than the length dimension; and wherein the tool comprises a radiused corner where the third closed side of the channel meets the first exterior face of the tool body at the first end of the channel, said radiused corner providing a smoothly curved transition that joins said third closed side of the channel to the first exterior face of the tool body and is free of any sharp edge therebetween, and the third closed side of the channel extends linearly from said radiused corner toward the second end of the channel;

whereby the envelope opening tool is configured to open an envelope under relative sliding of an edge of said envelope through the channel along the third closed side thereof from the first end of the channel to the second end of the channel to cut said envelope open along said edge thereof with the cutting edge of the blade pointing obliquely and inwardly away from the edge of the envelope due to the oblique orientation of the third closed side of the channel so as to minimize potential skipping of the tool off the envelope by inadvertent cutting of the blade through the envelope edge, while the radiused corner reduces resistance to relative sliding of the envelope through the channel.

2. The envelope opening tool of claim 1 wherein the first and second closed sides of the channel are parallel to one another at the region located between the third closed side of the channel and the first reference plane.

3. The envelope opening tool of claim 1 wherein the blade leaves a gap of between 0.75 and 1.75 thousandths of an inch between the cutting edge and the second closed side of the channel at the second end of said cutting edge.

4. The envelope opening tool of claim 1 wherein the blade leaves a gap of between 0.75 and 1.25 thousandths of an inch between the cutting edge and the second closed side of the channel at the second end of said cutting edge.

5. The envelope opening tool of claim 3 wherein the gap is 1.0 thousands of an inch.

6. The envelope opening tool of any one of claim 1 wherein spacing between the first reference plane and the third closed side of the channel, at the second end of the channel, is between 30 and 75 thousandths of an inch.

7. The envelope opening tool of claim 6 wherein the spacing between the first reference plane and the third closed side of the channel, at the second end of the channel, is 50 thousandths of an inch.

8. The envelope opening tool of claim 1 wherein an angle between the first reference plane and the third side of the channel is between 5 and 25 degrees.

9. The envelope opening tool of claim 8 wherein the angle between the first reference plane and the third side of the channel is between 5 and 15 degrees.

10. The envelope opening tool of claim 1 wherein the third closed side of the channel is concavely curved to smoothly join with the first and second closed sides of the channel.

11. The envelope opening tool of claim 1 wherein a through hole passes through the tool body along the thickness dimension thereof to accommodate passage of a key ring through the tool body for support of the tool body on a keychain.

12. The envelope opening tool of claim 11 wherein the slot and the through hole are positioned adjacent opposite ends of the tool body.

13. The envelope opening tool of claim 1 wherein the tool body comprises a wear insert that is entirely independent of the mounting of the blade to the tool body, defines at least a portion of one or more of the first, second and third closed sides of the channel and is surrounded by adjacent portions of the tool body on the first, second and third closed sides of the channel, the wear insert spanning a full length of the channel between the first and second ends thereof and comprising a material of greater hardness than said adjacent portions of the tool body.

14. The envelope opening tool of claim 13 wherein the wear insert includes an area at the second closed side of the channel that overlies the cutting edge of the blade.

15. The envelope opening tool claim 13 wherein the wear insert spans at least partially from the second closed side of the channel toward the opposing first closed side of the channel at the third closed side of the channel.

16. The envelope opening tool of claim 15 wherein the wear insert fully spans the third closed side of the channel from the first closed side thereof to the second closed side thereof, and spans at least partially along the first closed side of the channel from the third closed side of the channel toward the blade.

17. The envelope opening tool of claim 13 wherein the wear insert defines the radiused corner of the tool body.

18. The envelope opening tool of claim 13 wherein the wear insert comprises metal and the adjacent portions of the tool body comprises a non-metal material.

19. The envelope opening tool of claim 13 wherein the adjacent portions of the tool body are plastic.

20. An envelope opening tool comprising:

a tool body;

a slot passing through the tool body on an axis to define a channel that passes axially through opposing first and second exterior faces of the tool body at respective first and second open ends of said channel, the channel having first, second and third closed sides situated around the axis and a fourth open side opening outwardly from the tool body on one side of the axis, the first and second closed sides residing opposite one another and being joined together by the third closed side that resides opposite the fourth open side; and a blade mounted to the tool body and projecting into the channel from the first closed side thereof toward the second side to situate a cutting edge of the blade in a position residing within the channel and operable to cut an envelope along an edge of said envelope under relative movement of said edge of the envelope axially through the slot along the third closed side thereof, the cutting edge of the blade sloping obliquely away from the first closed side of the channel toward the second closed side and terminating in a pointed tip at an end of said cutting edge furthest from the first closed side of the channel;

wherein the tool body comprises a wear insert that defines at least a portion of both the second and third closed sides of the channel, is surrounded by adjacent portions of the tool body on said three closed sides of the channel, comprises a material of greater hardness than said adjacent portions of the tool body, includes a first area on the second closed side of the channel that overlies the pointed tip of the cutting edge of the blade at a spaced distance therefrom that leaves a gap between said first area of the wear insert and the pointed tip of the cutting edge, and also includes a second area on the third closed side of the channel.

21. The envelope opening tool of claim 20 wherein the first area of the wear insert on the second closed side of the channel overlies an entirety of the cutting edge of the blade in spaced relation therefrom.

22. The envelope opening tool of claim 20 wherein the wear insert fully spans the third closed side of the channel from the first closed side thereof to the second closed side thereof, and further spans at least partially along the first closed side of the channel from the third closed side of the channel toward the blade.

23. The envelope opening tool of claim 20 wherein, at a location where the third closed side of the channel meets the first exterior face of the tool body at the first open end of the channel, the wear insert defines a radiused corner providing a smoothly curved transition that joins said third closed side of the channel to said first exterior face of the tool body and is free of any sharp edge therebetween, and the third closed side of the channel extends linearly from said radiused corner toward the second open end of the channel.

24. The envelope opening tool of claim 20 wherein the wear insert comprises metal and the adjacent portion of the tool body comprises a non-metal material.

25. The envelope opening tool of claim 20 wherein the adjacent portion of the tool body is plastic.

26. An envelope opening tool comprising:

a tool body having a slot extending through said tool body along an axis to pass through opposing first and second exterior faces of said tool body to define a channel having a first end at said first face and a second end at said second face, said channel being closed on three sides thereof around the axis by opposing first and second closed sides of the channel and a third closed side of said channel interconnecting the first and second closed sides thereof, leaving a fourth side of the channel open between the first and second closed sides of the channel at a position opposing the third closed side; and a blade residing in a reference plane and having a width measured in and parallel to said reference plane in a direction in which the first and second ends of the channel are spaced apart, and a thickness that is smaller than said width and is measured perpendicularly to said width and transversely through said reference plane in a direction in which said third closed side and said fourth side of the channel are spaced apart, said blade being mounted to the tool body in a position projecting into the channel from the first closed side thereof toward the opposing second closed side to define a cutting edge residing in the reference plane entirely within the channel, the reference plane and the blade therein both being spaced away from both the third closed side of the channel and the fourth open side of the channel so as to both lie intermediately between the third closed side of the channel and the fourth open side of the channel, the cutting edge fully spanning the width of the blade on an obliquely sloped path from a first end of the cutting edge to a second end of the cutting edge that is situated fully across said width of the blade from the first end of said cutting edge, the first end of the cutting edge residing closer to the first end of the channel than the second end of the cutting edge, the second end of the cutting edge residing closer to the second end of the channel than the first end of the cutting edge, the second end of the cutting edge being located nearer to the second closed side of the channel than the first end of the cutting edge, and the third closed side of the channel having an oblique orientation relative to the reference plane such that the third closed side of channel is further from the reference plane at the first end of the channel than at the second end of the channel;

wherein the tool comprises a radiused corner where the third closed side of the channel meets the first exterior face of the tool body at the first end of the channel, said radiused corner providing a smoothly curved transition that joins said third closed side of the channel to the first exterior face and is free of any sharp edge therebetween, and the third closed side of the channel extends linearly toward the second end of the channel from said radiused corner;

whereby the envelope opening tool is configured to open an envelope under relative sliding of an edge of said envelope through the channel along the third closed side thereof from the first end of the channel to the second end of the channel to cut said envelope open along said edge thereof with the cutting edge of the blade pointing obliquely and inwardly away from the edge of the envelope due to the oblique orientation of the third closed side of the channel so as to minimize potential skipping of the tool off the envelope by inadvertent cutting of the blade through the envelope edge, while the radiused corner reduces resistance to relative sliding of the envelope through the channel.

27. An envelope opening tool comprising:

a tool body;

a slot extending through said tool body along an axis to pass through opposing first and second exterior faces of said tool body to define a channel having a first end at said first exterior face and a second end at said second exterior face, said channel being closed on three sides thereof around the axis by opposing first and second closed sides of the channel and a third closed side of said channel interconnecting the first and second closed sides thereof, leaving a fourth side of the channel open between the first and second closed sides of the channel at a position opposing the third closed side; and a blade residing in a reference plane and having a width measured in and parallel to said reference plane in a direction in which the first and second ends of the channel are spaced apart, and a thickness that is smaller than said width and is measured perpendicularly to said width and transversely through said reference plane in a direction in which said third closed side and said fourth side of the channel are spaced apart, said blade being mounted to the tool body in a fixed position projecting into the channel from the first closed side thereof toward the opposing second closed side to define a cutting edge positioned entirely within said reference plane inside the channel, the reference plane and the blade therein both being spaced away from both the third closed side of the channel and the fourth open side of the channel so as to both lie intermediately between the third closed side of the channel and the fourth side of the channel, the cutting edge fully spanning the width of the blade on an obliquely sloped path from a first end of the cutting edge to a second end of the cutting edge that is situated fully across said width of the blade from the first end of said cutting edge, the first end of the cutting edge residing closer to the first end of the channel than the second end of the cutting edge, the second end of the cutting edge residing closer to the second end of the channel than the first end of the cutting edge, and the second end of the cutting edge being located nearer to the second closed side of the channel than the first end of the cutting edge;

wherein the axis is perpendicular to said first and second exterior faces, the reference plane is parallel to the axis, and the third closed side of the channel has an oblique orientation relative to the axis such that the third closed side of the channel is further from the reference plane at the first end of the channel than at the second end of the channel;

whereby the envelope opening tool is configured to open an envelope under relative sliding of an edge of said envelope through the channel along the third closed side thereof from the first end of the channel to the second end of the channel to cut said envelope open along said edge thereof with the cutting edge of the blade pointing obliquely and inwardly away from the edge of the envelope due to the oblique orientation of the third closed side of the channel so as to minimize potential skipping of the tool off the envelope by inadvertent cutting of the blade through the envelope edge.

28. The envelope opening tool of claim 27 wherein the reference plane is perpendicular to a second reference plane that, in a region located between the third closed side of the channel and the blade, is occupied by the second closed side of the channel.

* * * * *